US006694773B1

(12) United States Patent
Snow et al.

(10) Patent No.: US 6,694,773 B1
(45) Date of Patent: Feb. 24, 2004

(54) CONDENSER SYSTEM WITH NONDETACHABLY COUPLED RECEIVER

(75) Inventors: James D. Snow, Tullahoma, TN (US); John W. Knecht, Murfreesboro, TN (US)

(73) Assignee: CalsonicKansei North America, Inc., Farmington, MI (US)

( * ) Notice: Subject to any disclaimer, the term of this patent is extended or adjusted under 35 U.S.C. 154(b) by 0 days.

(21) Appl. No.: 10/354,761

(22) Filed: Jan. 29, 2003

(51) Int. Cl.[7] ..... F25B 1/10

(52) U.S. Cl. ..... 62/510; 62/474

(58) Field of Search ..... 62/507, 509, 510, 62/467, 474, 475, 498, 85; 165/132, 173, 110

(56) References Cited

U.S. PATENT DOCUMENTS

| | | | | | |
|---|---|---|---|---|---|
| 5,375,327 | A | * | 12/1994 | Searfoss et al. | 29/890.06 |
| 5,580,451 | A | * | 12/1996 | Tack | 210/266 |
| 5,713,217 | A | * | 2/1998 | Baba | 62/509 |
| 5,868,002 | A | * | 2/1999 | Matsubayashi | 62/507 |
| 5,927,102 | A | | 7/1999 | Matsuo et al. | |
| 5,934,102 | A | * | 8/1999 | DeKeuster et al. | 62/509 |
| 5,946,940 | A | * | 9/1999 | Inoue | 62/509 |
| 6,170,287 | B1 | * | 1/2001 | Leitch et al. | 62/474 |
| 6,223,556 | B1 | * | 5/2001 | De Keuster et al. | 62/509 |
| 6,260,379 | B1 | | 7/2001 | Manwill et al. | |
| 6,295,832 | B1 | * | 10/2001 | Kato et al. | 62/509 |
| 6,470,704 | B2 | | 10/2002 | Shibata et al. | |
| 2003/0085026 | A1 | | 5/2003 | Kaspar et al. | |

FOREIGN PATENT DOCUMENTS

| | | | |
|---|---|---|---|
| JP | 08075317 A | * | 3/1996 |
| WO | WO 02/077548 A1 | | 10/2002 |

OTHER PUBLICATIONS

Pub. No.: US 2003/0044523 A1 to Brass, Pub. Date: Mar. 6, 2003.*

* cited by examiner

*Primary Examiner*—William E. Tapolcai
*Assistant Examiner*—Mohammad M. Ali
(74) *Attorney, Agent, or Firm*—Jordan M. Meschkow; Lowell W. Gresham; Meschkow & Gresham, PLC

(57) ABSTRACT

A condenser system (20) includes a first header (26), a second header (28), and parallel tubes (30) extending between the headers (26, 28). A receiver (24), affixed to the second header (28), is in fluid communication with the second header (28). The receiver includes a body (32), a first cap (38) coupled to the body (32), and a second cap (42) coupled to the body. The condenser system (20) is subjected to a one-shot brazing process that nondetachably couples the receiver (24) to the second header (28), and concurrently nondetachably couples the first and second caps (38, 42) to the receiver body (32). A desiccant system (124) and/or filter (138) may be optionally installed into the receiver (24) prior to brazing.

34 Claims, 5 Drawing Sheets

CONDENSER SYSTEM WITH NONDETACHABLY COUPLED RECEIVER

TECHNICAL FIELD OF THE INVENTION

The present invention relates to the field of air conditioning systems. More specifically, the present invention relates to a condenser for an air conditioning system in a motor vehicle having a nondetachably coupled receiver.

BACKGROUND OF THE INVENTION

In a conventional vapor compression system, vapor refrigerant is compressed in the compressor, where its temperature is raised above the temperature of the cooling medium used at the condenser. A mixture of vapor and liquid refrigerant then enters the condenser where heat is extracted, and the refrigerant changes to a liquid. The liquid refrigerant then enters the thermal expansion valve, which controls the quantity of liquid refrigerant passing to the evaporator coils. Finally, the liquid refrigerant enters the evaporator and evaporates. Heat from the ambient atmosphere, for example, in a vehicle passenger compartment, is rejected to the refrigerant in the evaporator where it is absorbed as the latent heat of vaporization as the refrigerant evaporates. The now vaporized refrigerant is then directed to the compressor to be recycled through the system.

Some vapor compression systems include a receiver dryer which is intended to perform some or all of the following functions: filtration and/or dehydration of the refrigerant, compensation for variations in its volume, and separation of the vapor and liquid phases of the refrigerant. Typically, an inlet pipe is coupled between an upstream section of the condenser and an inlet aperture of the receiver for carrying the vapor and liquid phases of the refrigerant to the receiver dryer. An outlet pipe is coupled between an outlet aperture of the receiver and a downstream section of the condenser header for returning the liquid phase of the refrigerant to the downstream section. Interposing the receiver dryer between upstream and downstream sections of the condenser ensures the fluid in the downstream section circulates only in the liquid state. The downstream section, or sub-cooler section, of the condenser sub-cools the liquid refrigerant to a point below the temperature at which the liquid changes to a gas. The sub-cooled liquid phase refrigerant quality is low and its enthalpy is also low which increases the evaporator's ability to absorb heat as the refrigerant evaporates, thus improving the efficiency of the vapor compression system.

Condenser systems used in vehicle air conditioning systems are typically manufactured by first assembling brazing clad condenser components together, then passing the assembled components through a brazing furnace to braze, or fuse, the components together. Typically, one or more brackets and fasteners are used to mount the receiver dryer, inlet pipe, and outlet pipe to a header of the condenser. The bracket or brackets may be first bolted or tack welded to the header prior to the brazing process. Bolting and tack welding prior to brazing is typically performed manually, thus resulting in undesirable labor costs for the manufacturing process.

Prior art receiver dryer systems require a portion of the receiver dryer to be removable for installation of the desiccant and/or filter after the condenser is brazed. After the desiccant and/or filter is installed in the receiver dryer, the receiver can then be permanently closed by welding a cap on one end. Alternatively, additional fasteners can be used for post-brazing assembly, as well as o-rings for sealing the receiver dryer.

Like the bolting and tack welding performed prior to brazing, post-brazing assembly is typically performed manually, thus resulting in undesirably high labor costs. In addition, a high number of discrete components increases the likelihood that the condenser system may be misassembled, and increases the potential for damaging the condenser system and/or receiver dryer during post-braze assembly. Moreover, for those designs that require the sealing of refrigerant by using fasteners and o-ring type seals, the possibility exists for leakage of refrigerant through the o-ring sealed joints. Thus, what is needed is a condenser system having a receiver securely and nondetachably coupled to a condenser header.

SUMMARY OF THE INVENTION

Accordingly, it is an advantage of the present invention that a condenser system is provided having a nondetachably coupled receiver.

It is another advantage of the present invention that the condenser system, having the nondetachably coupled receiver, is manufactured using a one-shot brazing process.

Another advantage of the present invention is that a condenser system, having a nondetachably coupled receiver, is provided that requires no post-braze assembly.

Yet another advantage of the present invention is that a condenser system having a nondetachably coupled receiver is provided that allows for quick modifications of its function by selectively including components for dehydrating and/or filtering refrigerant.

The above and other advantages of the present invention are carried out in one form by a condenser system that includes two spaced apart headers and a plurality of parallel tubes extending between the headers for passing refrigerant between the headers. A receiver is in fluid communication with one of the spaced apart headers. The receiver includes a body having first and second ends, a first cap coupled to the body at the first end and having a first saddle portion affixed to the one of the spaced apart headers, and a second cap coupled to the body at the second end.

The above and other advantages of the present invention are carried out in another form by a condenser system that includes two spaced apart headers and a plurality of parallel tubes extending between the headers for passing refrigerant between the headers. A receiver is in fluid communication with one of the spaced apart headers. The receiver includes a body having first and second ends. A first cap is nondetachably coupled to the first end of said body using a one-shot brazing process. The first cap has a first saddle portion nondetachably coupled to one of the spaced apart headers using the one-shot brazing process. A second cap is nondetachably coupled to the second end of the body using the one-shot brazing process. The second cap has a second saddle portion nondetachably coupled to the one spaced apart header using the one-shot brazing process.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
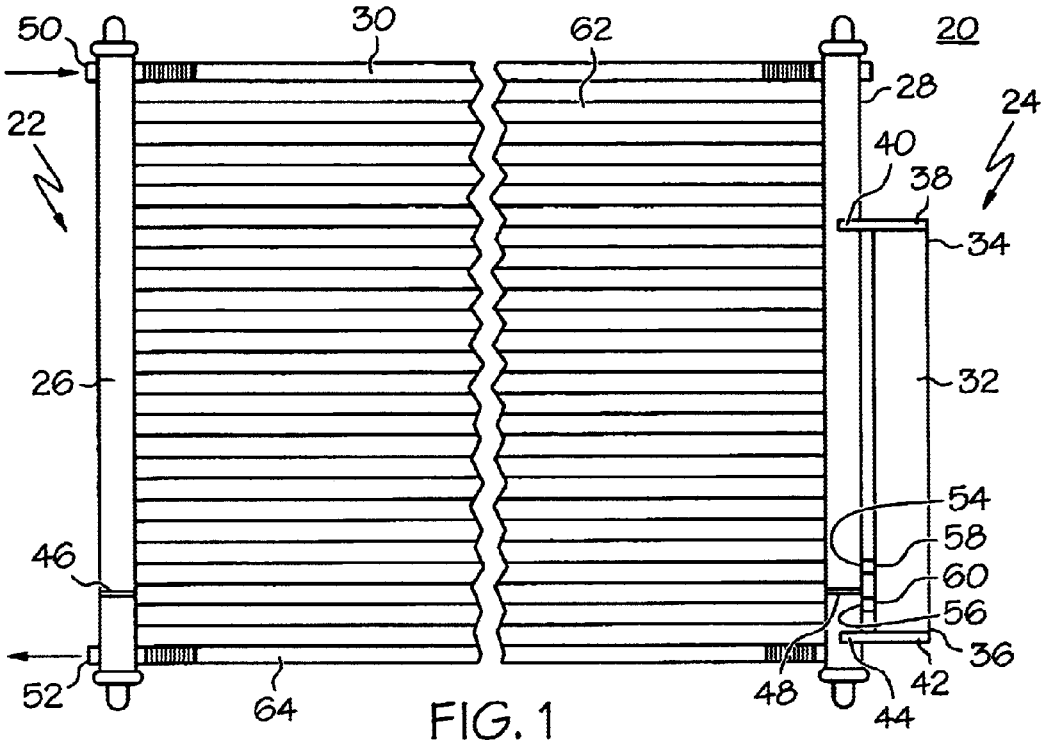
FIG. 1 shows a front view of a condenser system for a vapor compression system.

FIG. 1 shows a front view of a condenser system 20 for a vapor compression system (not shown). In an exemplary embodiment, the vapor compression system may be a vehicle air conditioning system known to those skilled in the art for cooling the passenger compartment of a vehicle. Condenser system 20 includes a condenser, generally designated 22, and a receiver, generally designated 24. Condenser 22 includes a pair of tubular, parallel headers, generally designated as a first header 26 and a second header 28. Parallel tubes 30 extend between first and second headers 26 and 28, respectively, for passing refrigerant between first and second headers 26 and 28.

Figure 2:
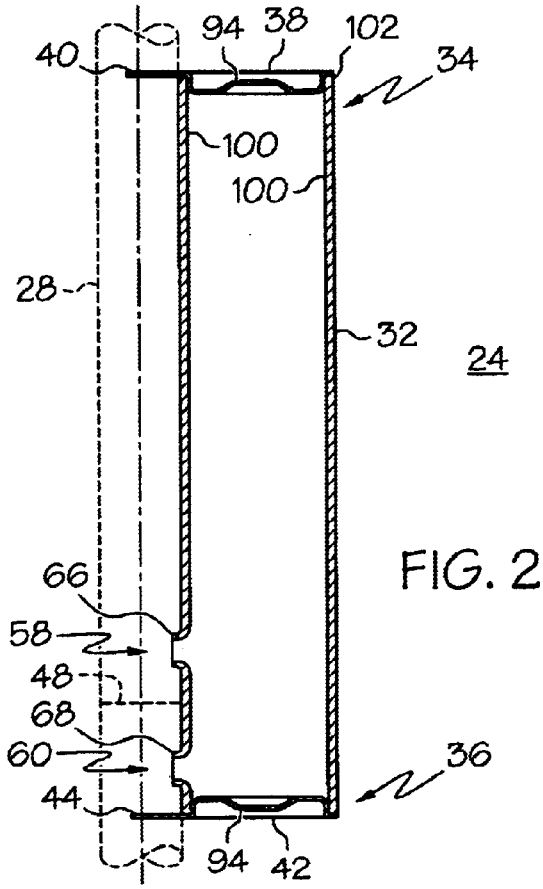
FIG. 2 shows a front sectional view of a receiver of the condenser system of FIG. 1.

Referring to FIG. 2 in connection with FIG. 1, FIG. 2 shows a front sectional view of receiver 24 of FIG. 1. Receiver 24 includes a body 32 having a first end 34 and a second end 36. A first cap 38 is nondetachably coupled to first end 34 of body 32. A first saddle portion 40 of first cap 38 is affixed to second header 28. Similarly a second cap 42 is nondetachably coupled to second end 36 of body 32, and a second saddle portion 44 of second cap 42 is affixed to second header 28.

In an exemplary embodiment, condenser 22 is a two pass condenser. As such, first header 26 includes an imperforate wall 46 extending through first header 26. Similarly, second header 28 includes an imperforate wall 48 extending through second header 28. First header 26 includes an inlet opening 50 above imperforate wall 46 for receiving a mixture of vapor and liquid phase refrigerant from a compressor (not shown) of the vehicle air conditioning system (not shown). Below imperforate wall 46, first header 26 includes an outlet opening 52 for directing liquid phase refrigerant from condenser 22 toward the evaporator (not shown) of the vehicle air conditioning system.

Second header 28 includes a header outlet port 54 above imperforate wall 48 and a header inlet port 56 below imperforate wall 48. An inlet aperture 58 of receiver 24 is in fluid communication with header outlet port 54 and an outlet aperture 60 of receiver 24 is in fluid communication with header inlet port 56.

In general, vapor and liquid phase refrigerant enters condenser system 20 at inlet 50 of first header 26. The refrigerant may be distributed by first header 26 to tubes 30 that are above imperforate wall 46, referred to generally as a first upstream section 62, to flow to second header 28. Once the vapor and liquid phase refrigerant enters second header 28, it is routed to receiver 24 via header outlet port 54 through inlet aperture 58.

Receiver 24 serves to separate the liquid phase refrigerant from the vapor phase refrigerant. After the liquid phase refrigerant and the vapor phase refrigerant are separated within receiver 24, liquid refrigerant enters second header 28 via outlet aperture 60 of receiver 24 through header inlet port 56. The liquid refrigerant is subsequently routed to tubes 30 below imperforate wall 48, referred to generally as a downstream section 64.

Downstream section 64, known as a sub-cooler section, of condenser system 20 sub-cools the liquid refrigerant to a point below the temperature at which the liquid changes to a gas. The sub-cooled liquid phase refrigerant increases the ability of the evaporator (not shown) of the vehicle air conditioning system to absorb heat as the refrigerant evaporates, thus improving the efficiency of the system. Following sub-cooling in downstream section 64, the liquid refrigerant passes to first header 26 below imperforate wall 46 and exits from outlet opening 52 for eventual receipt at the evaporator (not shown) of the vehicle air conditioning system (not shown).

Condenser system 20 is described as being a two pass condenser for illustrative purposes. However, it should be understood that the present invention is not limited to two pass condensers. Rather, the present invention may be adapted for use with two or more pass condenser systems in which a receiver is employed to separate the liquid phase refrigerant from the vapor phase refrigerant between passes.

Condenser system 20 is manufactured using a one-shot, or single, brazing process. That is, the components of condenser system 20, including receiver 24 with first and second caps 38 and 42, respectively, are first assembled together. The entire assembly is then passed through a brazing furnace to braze, or fuse, the components together. Through brazing, strong, uniform, leak-proof joints are formed. As such, no further assembly using fasteners, o-ring seals, welding, and so forth need be performed following the one-shot brazing process. The design of receiver 24 advantageously causes first and second caps 38 and 42 to fuse to body 32, during the same process that causes first and second saddle portions 40 and 44 to fuse to second header 28.

In a preferred embodiment, inlet aperture 58 and outlet aperture 60 are extruded openings. To form an extruded opening, a pilot hole is produced in receiver 24. The material around the pilot hole is formed outward to produce a collar around the hole. This collar provides support in a lap joint or butt weld connection when faced. Accordingly, as shown in FIG. 2, receiver 24 further includes a first formed collar 66 surrounding inlet aperture 58 and a second formed collar 68 surrounding outlet aperture 60. First and second formed collars 66 and 68, respectively, securely fuse to second header 28 about header outlet port 54 and header inlet port 56 during the one-shot brazing process. The nondetachable coupling of first and second collars 66 and 68 to second header 28 during the one-shot brazing process provides secure interconnection of inlet aperture 58 with header outlet port 54, and outlet aperture 60 with header inlet port 56. In addition, this coupling during brazing eliminates the need for any post-brazing assembly of additional pipes, fasteners, and so forth between second header 28 and receiver 24.

Figure 3:
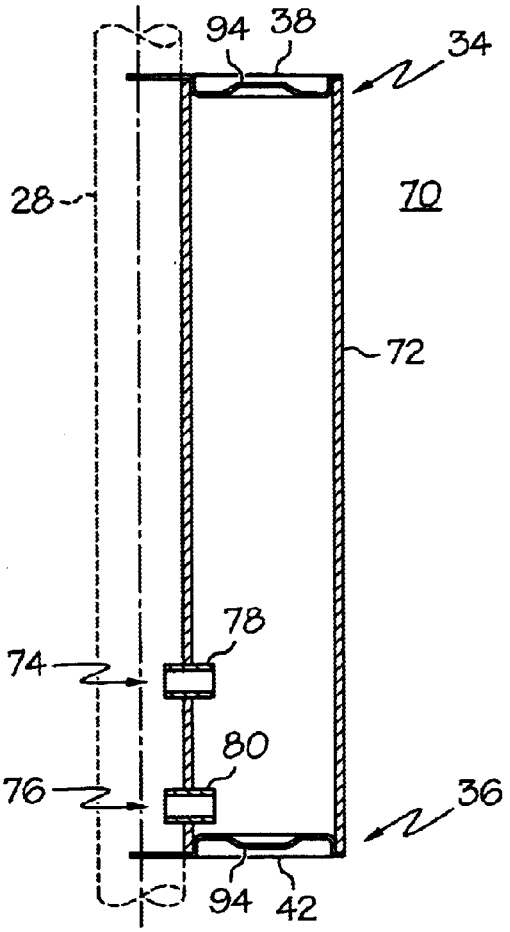
FIG. 3 shows a front sectional view of a receiver in accordance with an alternative embodiment of the present invention.

FIG. 3 shows a front sectional view of a receiver 70 in accordance with an alternative embodiment of the present invention. Receiver 70 includes a generally cylindrical body 72. First cap 38 is nondetachably coupled to first end 34 of body 72, and second cap 42 is nondetachably coupled to second end 36 of body 72.

Body 72 of receiver 70 includes an inlet aperture 74 and an outlet aperture 76. However, unlike inlet and outlet apertures 58 and 60, respectively, of receiver 24, inlet and outlet apertures 74 and 76 are not extruded openings. Rather, inlet and outlet apertures 74 and 76, respectively, may be simple drilled or punched holes. As such, condenser system 20 utilizing receiver 70, further includes a first tube 78 interconnected between header outlet port 54 (FIG. 1) and inlet aperture 74, and a second tube 80 interconnected between header inlet port 56 (FIG. 1) and outlet aperture 76.

First and second tubes 78 and 80 are installed as condenser system 20 is being assembled prior to the one-shot brazing process. Following assembly, first and second tubes 78 and 80 are brazed into place during the one-shot brazing process. Brazing rings (not shown) may optionally be slid onto tubes 78 and 80 to enhance the strength of the brazed joint formed by first and second tubes 78 and 80, between second header 28 and receiver 70. Although, receiver 70 calls for additional components (i.e., first and second tubes 78 and 80) relative to receiver 24, assembly still occurs prior to brazing. Consequently, like receiver 24, the configuration of receiver 70 with first and second tubes 78 and 80 also eliminates the need for any post-brazing assembly of additional pipes, fasteners, and so forth between second header 28 and receiver 70.

Figure 4:
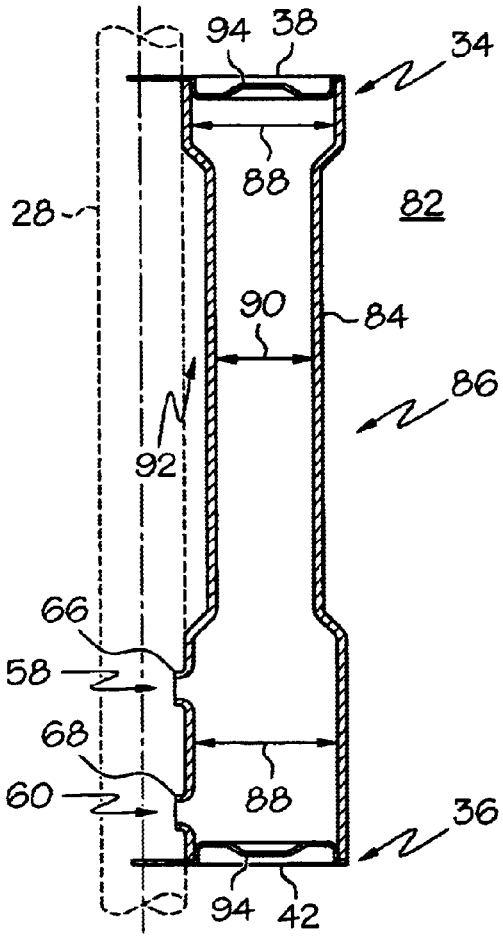
FIG. 4 shows a front sectional view of a receiver in accordance with another alternative embodiment of the present invention.

FIG. 4 shows a front sectional view of a receiver 82 in accordance with another alternative embodiment of the present invention. Receiver 82 includes a body 84. First cap 38 is nondetachably coupled to first end 34 of body 84, and second cap 42 is nondetachably coupled to second end 36 of body 84. Like receiver 24, receiver 82 further includes inlet aperture 58 surrounded by first formed collar 66, and outlet aperture 60 surrounded by second formed collar 68.

As shown in FIGS. 2 and 3, receiver 24 and receiver 70 are cylindrical having generally the same diameter along the entire length of the receiver. However, body. 84 differs from such a configuration. That is, body 84 exhibits a first diameter 88 at each of first and second ends 34 and 36. However, body 84 of receiver 82 further includes an intermediate span 86 interposed between first and second ends 34 and 36, respectively, exhibiting a second diameter 90 that is less than first diameter 88. Accordingly, an air gap 92 is formed between second header 28 and body 84 of receiver 82. Air gap 92 advantageously limits the transfer of heat between second header 28 and receiver 82.

Figure 5:
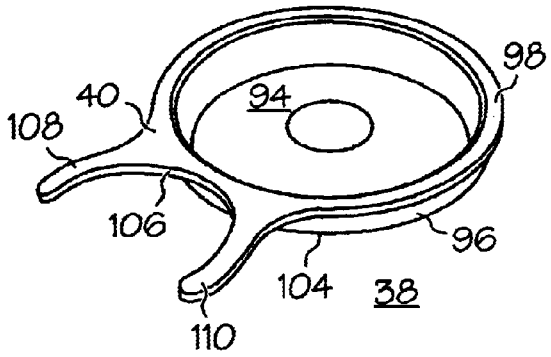
FIG. 5 shows a perspective view of a cap of the receivers of FIGS. 2–4 in accordance with a preferred embodiment of the present invention.
Figure 6:
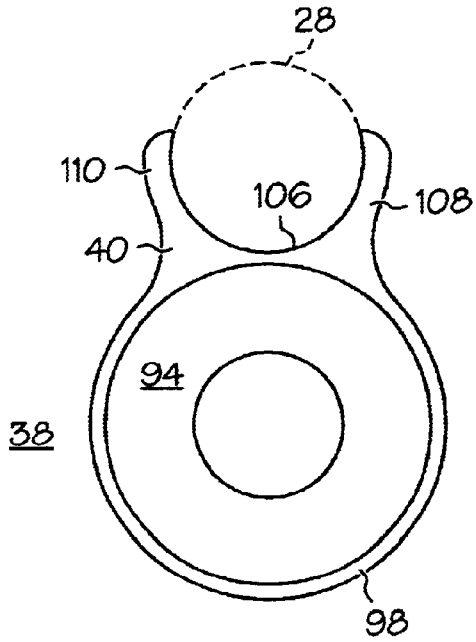
FIG. 6 shows a top view of the cap of FIG. 5.

Referring to FIGS. 5–6, FIG. 5 shows a perspective view of first cap 38 in accordance with a preferred embodiment of the present invention, and FIG. 6 shows a top view of first cap 38. It should be understood that second cap 42 is identical to first cap 38. Accordingly, although the following discussion describes first cap 38, the following discussion pertains to second cap 42 as well. In addition, first cap 38 is described in connection with receiver 24 (FIG. 2). However, first cap 38 may also be employed on receiver 70 and receiver 82.

First cap 38 includes an outwardly convex sealing portion 94, as best seen in FIGS. 2–4. The outwardly convex shape of sealing portion 94 yields a higher pressure durability strength then does a flat cap. Accordingly, the thickness of first cap 38 can be decreased relative to a flat cap, thereby reducing the materials cost of first cap 38.

First saddle portion 40 extends radially outward from a perimeter wall 96 of sealing portion 94. In addition, a lip 98 extends outwardly from perimeter wall 96. Perimeter wall 96 abuts an interior surface 100 (see FIG. 2) of body 32 (FIG. 2), and lip 98 abuts an edge 102 (see FIG. 2) of body 32 at first end 34. First cap 38 is press-fit onto first end 34 of body 32 prior to the aforementioned one-shot brazing process.

An inner surface 104 of first cap 38 is braze alloy clad. For example, first cap 38 may be metal stamped from a brazing sheet. A brazing sheet is a composite material having a core (such as, 3003 aluminum) that is clad, or covered, on one or both sides with an alloy (such as, 4045 aluminum) having a slightly lower melting temperature. Accordingly, when condenser system 20 (FIG. 1) is brazed, first cap 38 nondetachably couples to first end 34 of body 32 by brazing.

Second header 28 exhibits a substantially tubular shape, and first saddle portion 40 of cap 38 has a braze alloy clad concave surface 106 adapted for mating engagement with second header 28, shown in ghost form. In a preferred embodiment, first saddle portion 40 of first cap 38 includes a pair of distal arms, referred to generally as a first distal arm 108 and a second distal arm 110. First and second distal arms 108 and 110 extend symmetrically about a central axis with respect to the other of first and second distal arms 108 and 110. First and second distal arms 108 and 110 are configured to enable a snap fit of first saddle portion 40 about second header 28, thereby eliminating the need for tack welding prior to the one-shot brazing process. The snap fit simplifies system assembly, thus reducing the labor costs associated with condenser system 20 assembly.

Figure 7:
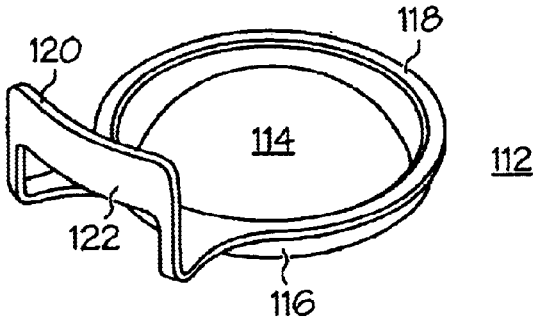
FIG. 7 shows a perspective view of a cap of the receivers of FIGS. 2–4 in accordance with an alternative embodiment of the present invention.
Figure 8:
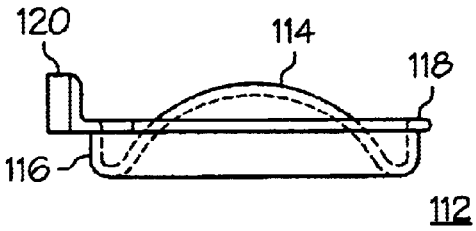
FIG. 8 shows a side view of the cap of FIG. 7.

Referring to FIGS. 7–8, FIG. 7 shows a perspective view of a cap 112 in accordance with an alternative embodiment of the present invention, and FIG. 8 shows a side view of cap 112. Cap 112 may be employed on any of receivers 24, 70, and 82 (FIGS. 2–4) in place of first and second caps 38 and 42, respectively.

Cap 112 includes an outwardly convex sealing portion 114 in the shape of a dome, and a perimeter wall 116 with a lip 118 extending outwardly therefrom. A saddle portion 120 extends axially outward from perimeter wall 116. That is, saddle portion 120, extends upwardly relative to lip 118 so that greater surface area of a concave surface 122 of saddle portion 120 is available for brazing to second header 28. This greater surface area creates a more secure joint between the receiver, such as, receiver 24, and second header 28. In such a configuration, only one cap 112 may be needed for coupling to second header 28, rather than the aforementioned two caps, i.e., first and second caps 38 and 42 (FIG. 1).

Saddle portion 120 may additionally include distal arms (not shown) that extend symmetrically about a central axis to enable a snap fit of saddle portion 120 about second header 28 so that tack welding is not necessary prior to the one-shot brazing process.

Figure 9:
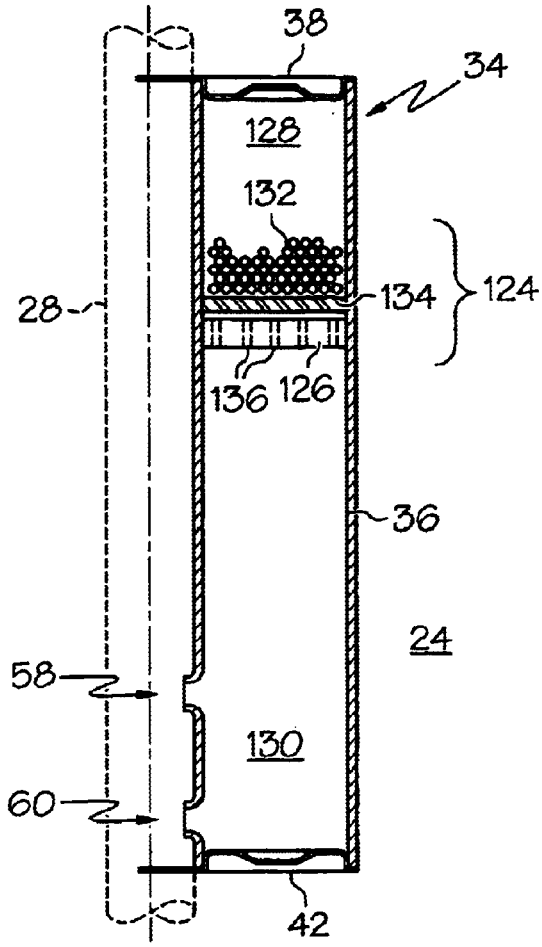
FIG. 9 shows a front sectional view of the receiver of FIG. 2 having a desiccant system positioned therein.
Figure 10:
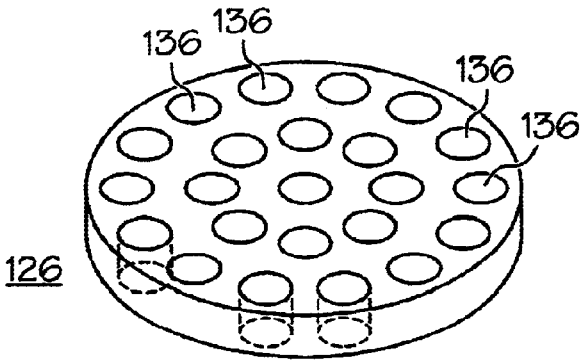
FIG. 10 shows a perspective view of a perforated holding plate of the desiccant system of FIG. 9.

Referring to FIGS. 9–10, FIG. 9 shows a front sectional view of receiver 24 having a desiccant system 124 positioned therein, and FIG. 10 shows a perspective view of a perforated holding plate 126 of desiccant system 124. When any of receivers 24, 70, and 82 (FIGS. 2–4) are intended to perform the function of dehydrating the refrigerant, desiccant system 124 is installed into the receiver prior to the one-shot brazing process.

Desiccant system 124 includes perforated holding plate 126 that splits an interior of body 32 into a first region 128 and a second region 130. A desiccant 132 is positioned in first region 128 and a cushion 134 is located between perforated holding plate 126 and desiccant 132. Inlet aperture 58 and outlet aperture 60 are located in second region 130. Desiccant 132 is XH-7 or XH-9 commonly used for automotive applications. However, other desiccant materials may alternatively be employed within desiccant system 124. Perforated holding plate 126 holds desiccant 132 and cushion 134 in place in first region 128, but allows for refrigerant dehydration by direct contact of the refrigerant to the desiccant through holes 136 of perforated holding plate 126.

In a preferred embodiment, perforated holding plate 126 is fabricated from aluminum material that is staked in place prior to the one-shot brazing process. Alternatively, perforated holding plate 126 may be a brazing clad aluminum material that is press-fit into receiver 24 during assembly of condenser system 20 (FIG. 1), and subsequently fused to receiver 24 during the one-shot brazing process.

A conventional material utilized for cushioning within prior art receivers is polyester felt. Unfortunately, polyester felt cannot withstand the high temperatures imposed on receiver 24 during the one-shot brazing process. Accordingly, in a preferred embodiment, cushion 134 is fabricated from fiberglass needled mat, such as that provided by Lance Brown Import-Export, Balcatta Washington, Australia. Fiberglass needled mat is a mechanically bonded e-glass glass fiber insulation blanket of uniform density. It is manufactured from a controlled assortment of long textile glass fibers to ensure uniform mechanical bonding with no additional binders. Fiberglass needled mat is incombustible and has a softening temperature at 850° C. Thus, fiberglass needled mat can readily withstand brazing temperatures in the range of 650° C. without sustaining damage.

In an alternative preferred embodiment, cushion 134 is fabricated from pre-oxidized acrylic felt, such as that provided by Saveguard Innovative Textile Products, Dukinfield, Cheshire, UK. Pre-oxidized acrylic felt is also advantageous in that in can readily withstand brazing temperatures in the range of 650° C. without sustaining damage.

Figure 11:
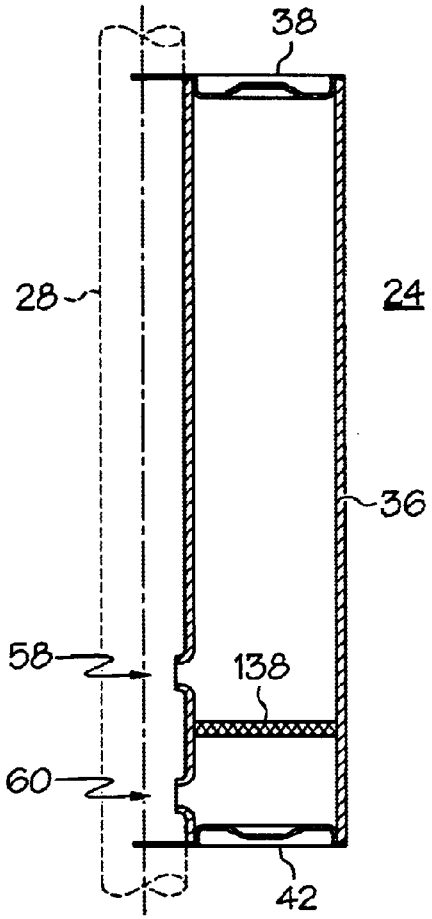
FIG. 11 shows a front sectional view of the receiver of FIG. 2 having a filter positioned therein.
Figure 12:
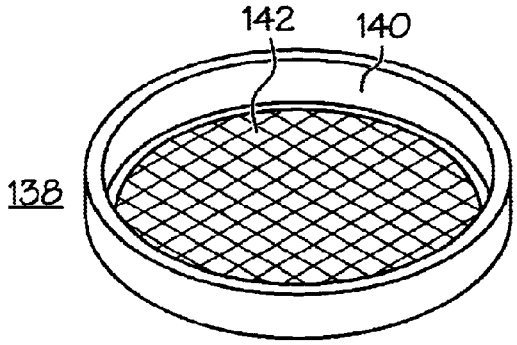
FIG. 12 shows a perspective view of the filter of FIG. 11.
Figure 13:
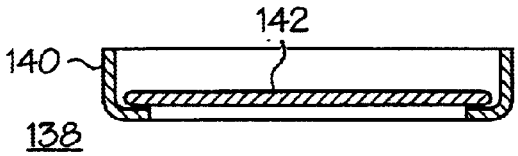
FIG. 13 shows side view of the filter of FIG. 11.

Referring to FIGS. 11–13, FIG. 11 shows a front sectional view of 24 having a filter 138 positioned therein. FIG. 12 shows a perspective view of filter 138, and FIG. 13 shows side view of filter 138. When any of receivers 24, 70, and 82 (FIGS. 2–4) are intended to perform the function of filtering the refrigerant, filter 138 is installed into the receiver prior to the one-shot brazing process. Filter 138 is described separately form desiccant system 124 (FIG. 9) for simplicity of illustration. However, it should be understood that any of receivers 24, 70, and 82 may serve the functions of both dehydrating and filtering the refrigerant. In such a scenario, the receiver will include both desiccant system 124 and filter 138.

Filter 138 includes retaining ring 140 and a filter screen 142 held by retaining ring 140. Filter 138 is positioned in the interior of receiver 24 between inlet aperture 58 and outlet aperture 60. Accordingly, contaminants in the refrigerant entering receiver 24 through inlet aperture 58 are filtered from the refrigerant prior to exiting receiver 24 through outlet aperture 60.

A conventional filter utilized within prior art receivers is fabricated as a plastic housing with a plastic mesh. Unfortunately, the plastic cannot withstand the high temperatures imposed on receiver 24 during the one-shot brazing process. Accordingly, in a preferred embodiment, retaining ring 140 is desirably fabricated from aluminum material that is staked in place prior to the one-shot brazing process. Alternatively, retaining ring 140 may be a brazing clad aluminum material that is press-fit into receiver 24 during assembly of condenser system 20 (FIG. 1), and subsequently fused to receiver 24 during the one-shot brazing process.

In addition, filter screen 142 is fabricated from a stainless steel filter mesh sized to allow the flow of refrigerant while capturing the contaminants. Filter screen 142 may be tack welded or brazed to retaining ring 140. Filter 138 is subsequently installed in receiver 24 prior to the one-shot brazing process.

Figure 14:
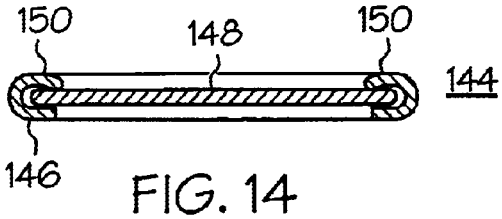
FIG. 14 shows a side view of a filter for use with the receivers of FIGS. 2–4 in accordance with an alternative embodiment of the present invention.

FIG. 14 shows a side view of a filter 144 in accordance with an alternative embodiment of the present invention. Filter 144 may be employed in any of receivers 24, 70, and 82 (FIGS. 2–4) in place of filter 138 (FIG. 11). Filter 144 includes a retaining ring 146 and a filter screen 148. Filter screen 148 is desirably fabricated from stainless steel filter mesh, as discussed above. Retaining ring 146 varies from retaining ring 140 in that retaining ring 146 includes a crimp edge 150. During assembly of filter 144, filter screen 148 is installed in retaining ring 146, and crimp edge 150 is crimped to hold filter screen 148 in retaining ring 146. Filter 144 is subsequently installed in receiver 24 prior to the one-shot brazing process, as discussed above.

Figure 15:
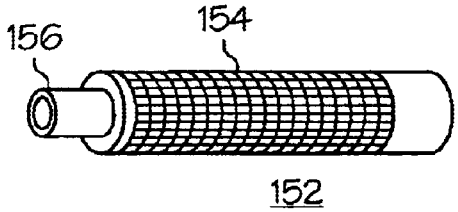
FIG. 15 shows a perspective view of a filter for use with the receivers of FIGS. 2–4 in accordance with another alternative embodiment of the present invention.

FIG. 15 shows a perspective view of a filter 152 in accordance with another alternative embodiment of the present invention. Filter 152 may be employed in any of receivers 24, 70, and 82 (FIGS. 2–4) in place of filter 138 (FIG. 11) and filter 144 (FIG. 14).

Filter 152 includes a cylindrical filter screen body 154 having a filter outlet 156. Filter 152 is desirably fabricated from a material, such as stainless steel and/or aluminum, that can withstand high brazing temperatures. Filter 152 is positioned in the interior of receiver 24 such that filter outlet 156 seats within outlet aperture 60. Accordingly, contaminants in the refrigerant entering receiver 24 through inlet aperture 58 are filtered from the refrigerant through filter 152 prior to exiting receiver 24 through filter outlet 156 and outlet aperture.60. Filter 152 is tack welded or press-fit in place prior to the one-shot brazing process.

In summary, the present invention teaches of condenser system having a nondetachably coupled receiver. The snap fit retention of the caps onto the tubular header, provides a self-fixturing subassembly until brazing permanently couples the receiver onto the header. In addition, press-fit retention of the caps to the body of the receiver also provides a self-fixturing subassembly until the same brazing process permanently couples the caps onto the receiver body. Accordingly, through the use of a one-shot brazing process, the receiver requires no post-braze assembly, thus speeding up production time, and decreasing labor costs. In addition, the one-shot brazing process yields secure, leak-proof joints suitable for long-term use. A desiccant system and/or a filter capable of withstanding the brazing temperatures can be selectively installed in the receiver prior to brazing, thus allowing for quick modifications of the receiver function.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A condenser system comprising:

two spaced apart headers;

a plurality of parallel tubes extending between said headers for passing refrigerant between said headers; and a receiver in fluid communication with one of said spaced apart headers, said receiver including:

a body having first and second ends, each of said first and second ends of said body exhibiting a first diameter, and said body further including an intermediate span interposed between said first and second ends, said intermediate span exhibiting a second diameter, said second diameter being less than said first diameter such that an air gap is formed between said one of said spaced apart headers and said receiver;

a first cap coupled to said body at said first end and having a first saddle portion affixed to one of said spaced apart headers; and a second cap coupled to said body at said second end, said second cap having a second saddle portion affixed to said one of said spaced apart headers.

2. A condenser system as claimed in claim 1 wherein said first cap is nondetachably coupled to said first end of said body and said second cap is nondetachably coupled to said second end of said body.

3. A condenser system as claimed in claim 2 further comprising a desiccant positioned in an interior of said body prior to nondetachable coupling of said first and second caps to said body.

4. A condenser system as claimed in claim 2 further comprising a filter positioned in an interior of said body prior to nondetachable coupling of said first and second caps to said body.

5. A condenser system as claimed in claim 4 wherein said filter comprises:

a retaining ring having an outer side wall for nondetachable coupling to an inner surface of said body; and a filter screen held by said retaining ring.

6. A condenser system as claimed in claim 4 wherein said filter is formed of stainless steel.

7. A condenser system as claimed in claim 2 wherein said first and second caps include a braze alloy clad surface for nondetachable coupling of said first and second caps to respective ones of said first and second ends by brazing.

8. A condenser system as claimed in claim 1 wherein said saddle portion of said first cap is braze alloy clad for nondetachable coupling of said saddle portion to said one of said spaced apart headers by brazing.

9. A condenser system as claimed in claim 1 wherein each of said first and second caps further comprises a sealing portion having a perimeter wall abutting an inner surface of said body at a corresponding one of said first and second ends.

10. A condenser system as claimed in claim 9 wherein said each of said first and second caps further comprises a lip outwardly extending from said perimeter wall and abutting an edge of said body at said corresponding one of said first and second ends.

11. A condenser system as claimed in claim 1 wherein each of said first and second caps further comprises an outwardly convex sealing portion covering a corresponding one of said first and second ends of said body.

12. A condenser system as claimed in claim 1 wherein said one spaced apart header exhibits a substantially tubular shape, and said saddle portion has a concave surface for mating engagement with said one spaced apart header.

13. A condenser system as claimed in claim 12 wherein each of said first and second saddle portions includes a pair of distal arms, each of said distal arms extending symmetrically about said one spaced apart header with respect to the other of said distal arms for enabling a snap fit of said each of said first and second saddle portions about said one spaced apart header.

14. A condenser system as claimed in claim 1 wherein said first cap includes a sealing portion, and said first saddle portion extends radially outward from an outer perimeter of said sealing portion.

15. A condenser system as claimed in claim 1 wherein said first cap includes a sealing portion, and said first saddle portion extends axially outward from an outer perimeter of said sealing portion.

16. A condenser system as claimed in claim 1 wherein said receiver further includes:

an inlet aperture having a first formed collar brazed to a header outlet port of said one of said spaced apart headers; and an outlet aperture having a second formed collar brazed to a header inlet port of said one of said spaced apart headers.

17. A condenser system as claimed in claim 1 wherein:

said first one of said spaced apart headers includes an outlet port and an inlet port;

said body of said receiver includes an inlet aperture and an outlet aperture; and said condenser system further comprises a first tube interconnected between said outlet port and said inlet aperture by brazing, and a second tube interconnected between said inlet port and said outlet aperture by said brazing.

18. A condenser system comprising:

two spaced apart headers;

a plurality of parallel tubes extending between said headers for passing refrigerant between said headers;

a receiver in fluid communication with one of said spaced apart headers, said receiver including:

a body having first and second ends;

a first cap coupled to said body at said first end and having a first saddle portion affixed to one of said spaced apart headers; and a second cap coupled to said body at said second end, said first cap being nondetachably coupled to said first end of said body and said second cap being nondetachably coupled to said second end of said body;

a desiccant positioned in an interior of said body prior;

a perforated holding plate retained in said body, said perforated holding plate splitting said interior of said body into a first region and a second region, said desiccant being located in said first region and inlet and outlet apertures of said receiver being located in said second region; and a cushion positioned between said perforated holding plate and said desiccant in said first region.

19. A condenser system as claimed in claim 18 wherein said cushion is a fiberglass needled mat material.

20. A condenser system as claimed in claim 18 wherein said cushion is a pre-oxidized acrylic felt material.

21. A condenser system comprising:

two spaced apart headers;

a plurality of parallel tubes extending between said headers for passing refrigerant between said headers; and a receiver in fluid communication with one of said spaced apart headers, said receiver including:

a body having first and second ends;

a first cap nondetachably coupled to said first end of said body using a one-shot brazing process, and having a first saddle portion nondetachably coupled to one of said spaced apart headers using said one-shot brazing process; and a second cap nondetachably coupled to said second end of said body using said one-shot brazing process, and having a second saddle portion nondetachably coupled to said one of said spaced apart headers using said one-shot brazing process.

22. A condenser system as claimed in claim 21 wherein said receiver further includes:

a desiccant;

a perforated holding plate retained in said body, said perforated holding plate splitting said interior of said body into a first region and a second region, said desiccant being located in said first region and inlet and outlet apertures of said receiver being located in said second region; and a cushion positioned between said perforated holding plate and said desiccant in said first region, said desiccant, said perforated holding plate, and said cushion being positioned in an interior of said body prior to said one-shot brazing process.

23. A condenser system as claimed in claim 22 wherein said cushion is a fiberglass needled mat material.

24. A condenser system as claimed in claim 22 wherein said cushion is a pre-oxidized acrylic felt material.

25. A condenser system as claimed in claim 21 wherein said receiver further comprises a filter positioned in an interior of said body prior to said one-shot brazing process.

26. A condenser system as claimed in claim 25 wherein said filter comprises:

a retaining ring having an outer side wall for nondetachable attachment to an inner surface of said body; and a filter screen held by said retaining ring.

27. A condenser system as claimed in claim 25 wherein said filter is formed of stainless steel.

28. A condenser system comprising:

two spaced apart headers, one of said spaced apart headers exhibiting a substantially tubular shape;

a plurality of parallel tubes extending between said headers for passing refrigerant between said headers; and a receiver in fluid communication with one of said spaced apart headers, said receiver including:

a body having first and second ends;

a first cap coupled with said body at said first end and having a first saddle portion having a first concave surface for mating engagement with said one spaced apart header; and a second cap coupled with said body at said second end and having a second saddle portion having a second concave surface for mating engagement with said one spaced apart header, said first and second saddle portions being nondetachably coupled to said one of said spaced apart headers using a one-shot brazing process.

29. A condenser system as claimed in claim 28 wherein said each of said first and second saddle portions includes a pair of distal arms, each of said distal arms extending symmetrically about said one spaced apart header with respect to the other of said distal arms for enabling a snap fit of said each of said first and second saddle portions about said one spaced apart header prior to said one-shot brazing process.

30. A condenser system as claimed in claim 28 wherein each of said first and second ends of said body exhibits a first diameter, and said body includes an intermediate span interposed between said first and second ends, said intermediate span exhibiting a second diameter that is less than said first diameter such that an air gap is formed between said one of said spaced apart headers and said receiver.

31. A condenser system as claimed in claim 28 wherein each of said first and second caps further comprises:

a sealing portion having a perimeter wall abutting an inner surface of said body at a corresponding one of said first and second ends; and a lip outwardly extending from said perimeter wall and abutting an edge of said body at said corresponding one of said first and second ends.

32. A condenser system as claimed in claim 28 wherein said first and second caps are nondetachably coupled to respective ones of said first and second ends using said one-shot brazing process.

33. A condenser system as claimed in claim 28 wherein each of said first and second caps includes a sealing portion, and a corresponding one of said first and second saddle portions extends radially outward from an outer perimeter of said sealing portion.

34. A condenser system as claimed in claim 28 wherein said receiver further includes:

an inlet aperture having a first formed collar nondetachably coupled to a header outlet port of said one of said spaced apart header using said one-shot brazing process; and an outlet aperture having a second formed collar nondetachably coupled to a header inlet port of said one of said spaced apart headers using said one-shot brazing process.

* * * * *